United States Patent [19]

van Lit

[11] 4,378,081

[45] Mar. 29, 1983

[54] ACTUATOR OVERCAP FOR TILT VALVE

[76] Inventor: Klaas J. van Lit, Logger 15, Amstelveen, Netherlands

[21] Appl. No.: 214,071

[22] Filed: Dec. 8, 1980

[51] Int. Cl.[3] ..... B65D 23/14

[52] U.S. Cl. ..... 222/402.13; 222/402.21; 222/505

[58] Field of Search ..... 222/402.13, 402.15, 222/402.21, 402.22, 402.23, 505, 507

[56] References Cited

U.S. PATENT DOCUMENTS

| | | | |
|---|---|---|---|
| 2,953,283 | 9/1960 | Palkowski | 222/505 X |
| 3,236,421 | 2/1966 | Glazier | 222/402.13 |
| 3,515,316 | 6/1970 | Green | 222/505 X |
| 3,726,444 | 4/1973 | Ostrowsky et al. | 222/505 X |
| 3,887,115 | 6/1975 | Petterson | 222/402.13 |
| 4,068,782 | 1/1978 | Van Der Heijden | 222/402.13 |

*Primary Examiner*—Joseph J. Rolla

*Assistant Examiner*—Frederick R. Handren

[57] ABSTRACT

An actuator-overcap for use with pressurized aerosol containers of the type having tilt-actuatable valves. The actuator-overcap includes a fixed portion and a tab portion movably attached thereto through a peripherally located hinge. The tab portion includes a laterally-facing finger-contact surface which is radially depressible to actuate the valve. The tab portion also includes an overhang which is axially adjacent to the distal end of a valve stem extension. The valve stem extension has an upward-facing bearing surface which is contacted by a downward-facing wedging surface on the overhang of the tab portion. The wedging surface is engageable with the bearing surface at a position radially opposite the position of the hinge such that radial depression of the finger-contact surface provides a wedging action on the extension causing it to tilt toward the hinge position.

8 Claims, 7 Drawing Figures

ACTUATOR OVERCAP FOR TILT VALVE

This invention relates in general to pressurized dispensing and in particular to actuator-overcaps for tilt valves on aerosol containers.

BACKGROUND OF THE INVENTION

A wide variety of actuating devices have been used in aerosol dispensers having tilt-actuated valves. Examples are: devices in which direct finger pressure is applied to the valve stem in a direction normal to the stem, such as the devices shown in U.S. Pat. Nos. 2,615,597 and 2,992,760; devices having a trigger piece fixedly attached to the valve stem and designed to be laterally displaced to tilt the stem, such as the device shown in U.S. Pat. No. 3,583,607; devices in which a trigger piece is arranged to be laterally displaced to contact and laterally displace the valve stem, such as the device shown in U.S. Pat. No. 3,236,421; extension devices fixedly attached to the valve stem and providing a depression point laterally offset from the stem whereby the stem may be tilted when the extension device is depressed in a direction parallel to the valve stem, such as devices shown in U.S. Pat. No. 3,330,447; and devices which push the stem away by sliding lateral contact on the stems, such as the device shown in U.S. Pat. No. 4,068,782.

None of these devices is particularly suitable for a wall-mounted aerosol product, such as might be used for periodic discharge of aerosol air fresheners and/or disinfectants in rooms frequently subject to malodors. Indeed, many wall-mounted devices have utilized pull cords which dangle downwardly from the aerosol actuators and may be pulled to actuate the aerosol valves, which typically are actuated by axial depression of the valve stem rather than tilting thereof. Such pull-cord devices have certain drawbacks, including unsightly appearance and a tendency for the containers to be pulled from the wall.

Wall-mounted devices having tilt-actuated valves have a disadvantage relating to the direction of spray discharge. The direction of valve tilting is important because if the valve stem is tilted toward the wall the spray discharge may impinge upon the wall and cause discoloration or other problems. Therefore, a tilt-actuatable valve which is actuated by radial depression of a device to tilt the valve in the direction of radial depression is unsatisfactory. Furthermore, attempts to solve this problem by skewing the discharge orifice to offset the usual tilt have the additional disadvantage of requiring initial orientation of the device with respect to the wall, a most impractical operation.

BRIEF SUMMARY OF THE INVENTION

The present invention provides a unique actuating device for use with pressurized dispensers of the type having tilt-actuatable valves. The device of this invention includes, of course, a container with a tiltable valve stem extending upward therefrom and defining an axis, and an actuator-overcap having a fixed portion secured to the container and a tab portion movably secured to the fixed portion through a hinge.

In this invention, an extension member which is attached to the stem has a spray orifice at its distal end and an upward-facing bearing surface, preferably at its distal end. The tab portion of the actuator-overcap is peripherally hinged to the fixed portion, that is, at the lateral wall of the actuator-overcap fixed portion. The hinge is located at a position axially spaced from the bearing surface of the stem extension member, allowing substantial movement of the tab portion with respect to the extension bearing surface.

The tab portion has a laterally-facing finger-contact surface axially adjacent to the hinge. The tab portion also has an overhang axially adjacent to the distal end of the extension member. The overhang defines an opening exposing the spray orifice and includes a downward-facing wedging surface adjacent to the opening and engageable with the bearing surface at a position radially opposite the hinge position. When the finger-contact surface is radially depressed the normal limited rotational movement about the hinge causes the wedging surface of the tab portion to exert pressure on the bearing surface of the extension member and thereby tilt the extension toward the hinge position.

The aerosol package of this invention may be hung on a wall with the finger-contact surface away from the wall such that it may easily be depressed by an operator. And, even though the operator depresses the tab toward the wall, the stem will be tilted thereby away from the wall such that the wall will not be sprayed. Furthermore, with this invention there is no necessity for a pull cord to actuate the device.

In certain preferred embodiments of this invention, the bearing surface may be a circular ridge surrounding the discharge orifice at the distal end of the extension member. The wedging surface of the tab portion overhang is preferably two substantially parallel edges which extend across the circular ridge and are inclined or angled slightly such that the parallel edges contact the circular ridge at single points which together are centered radially opposite the hinge position. The peripheral hinge between the tab portion and the fixed portion of the actuator-overcap is preferably axially spaced from the bearing surface in a downward direction, such that the finger-contact surface extends in an upward direction therefrom.

OBJECTS OF THE INVENTION

One object of this invention is to provide an actuator for tilt-actuatable valves which overcomes the aforementioned problems and disadvantages.

Another object of this invention is to provide a wall-mounted aerosol package which eliminates certain disadvantages of prior wall-mounted containers.

Another object of this invention is to provide a new actuator for tilt-actuatable valves which is particularly advantageous for wall-mounted aerosol dispensers.

A specific object of this invention is to provide a wall-mounted pressurized package which may be actuated directly and easily and which avoids spraying of the aerosol product on the wall.

These and other objects will be apparent from the following description of preferred embodiments wherein:

DETAILED DESCRIPTION OF PREFERRED EMBODIMENTS

Figure 1:
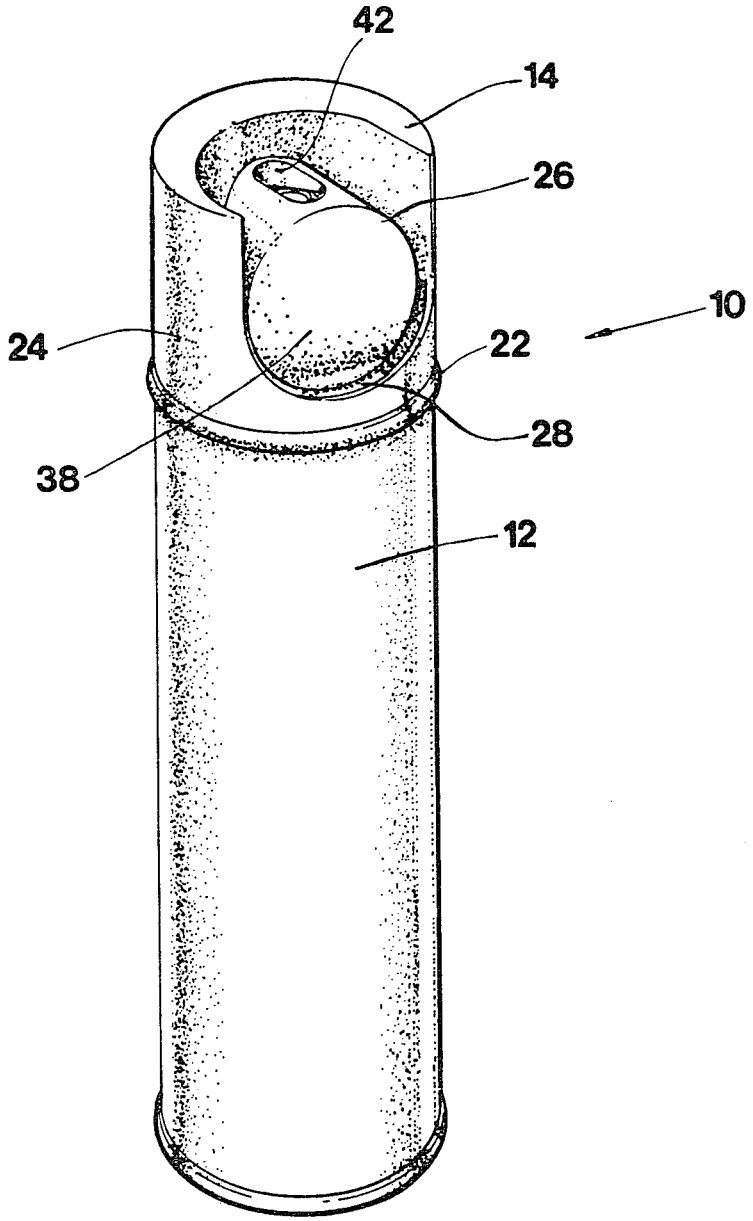
FIG. 1 is a perspective view of a pressurized package in accordance with this invention.
Figure 2:
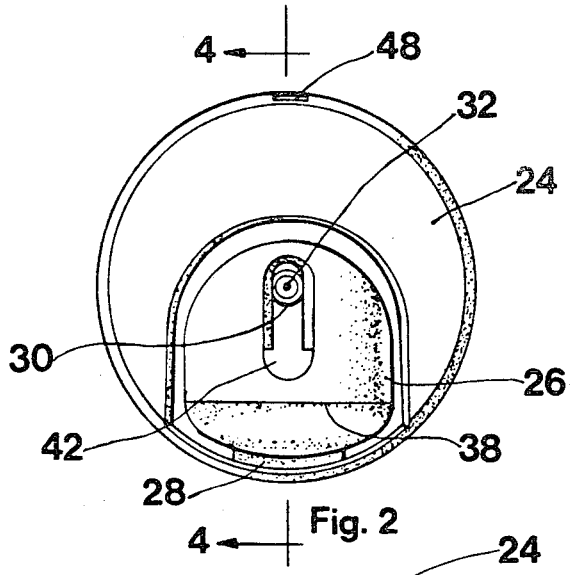
FIG. 2 is an enlarged top view of FIG. 1.
Figure 3:
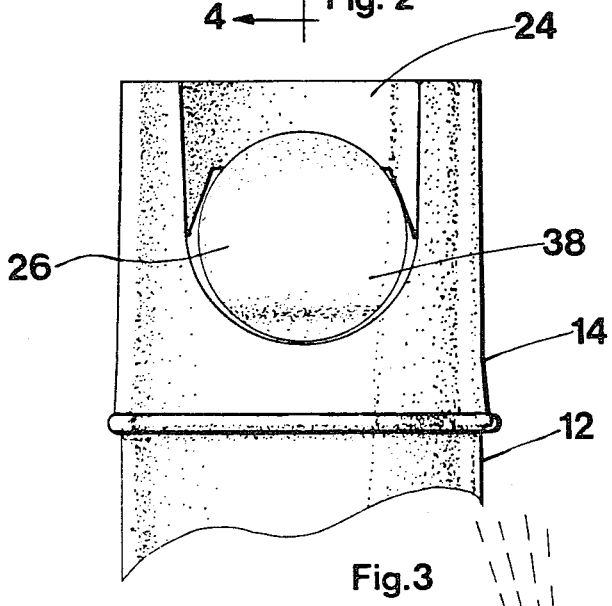
FIG. 3 is a fragmentary front elevation of the device of FIG. 1.

The figures show a pressurized package 10 having a container 12, which is a standard cylindrical metal container, and an actuator-overcap 14 secured thereto at its valved end. Container 12 also includes a dome 16, a valve cup 18, and an aerosol valve 20. Valve 20 includes a tiltable valve stem 23 extending upward from container 12. Stem 23 serves to define an axis line, which is also the axis of cylindrical container 12. The axis line defined by stem 23 is a useful reference location for describing the instant invention.

Actuator-overcap 14 includes a fixed portion 24 which is attached to container 12 at doubleseam 22. Actuator-overcap 14 also includes a tab portion 26 which is movably secured to fixed portion 24 through a peripheral hinge 28, that is, a hinge located at the lateral wall of fixed portion 24. Tab portion 26 moves with respect to fixed portion 24 about hinge 28 to actuate aerosol valve 20.

Frictionally engaged to valve stem 23 is a stem extension 30 which has a spray orifice 32 at its distal end 34. The tilting of extension 30 tilts valve stem 23 and actuates valve 20 of pressurized package 10 to discharge the fluid product within container 12. Extension 30 has an upward-facing circular ridge 36 which forms a bearing surface for contact by tab portion 26 to tilt extension member 30, as will be hereafter explained. Circular ridge 36 is concentric with orifice 32 at distal end 34 of extension member 30.

Figure 5:
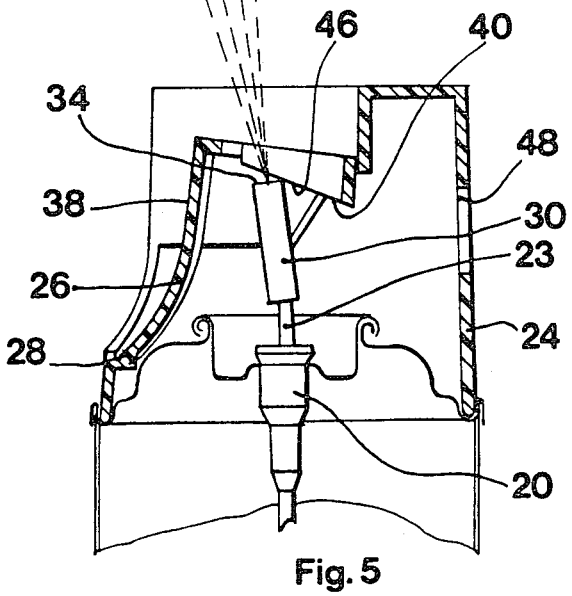
FIG. 5 is a side sectional view as in FIG. 4, illustrating the device in an actuated condition.
Figure 6:
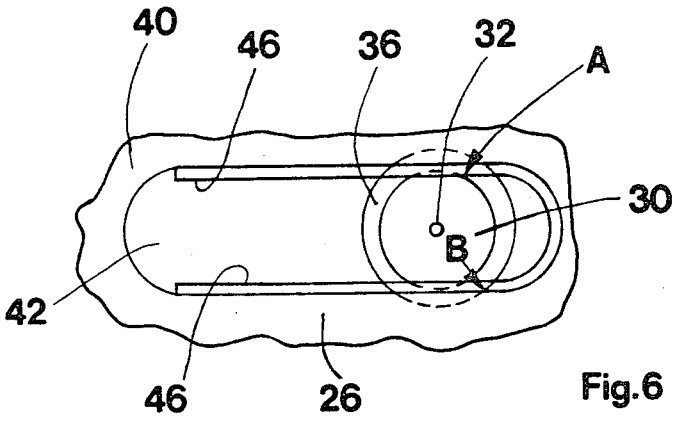
FIG. 6 is a further enlarged, fragmentary view of FIG. 2.

Tab portion 26 of actuator-overcap 14 includes a laterally-facing finger-contact surface 38 which is axially adjacent to hinge 28. Tab portion 26 also includes an overhang 40 axially adjacent to distal end 34. Overhang 40 defines an opening 42 which exposes spray orifice 32, as best illustrated in FIGS. 5 and 6.

Figure 4:
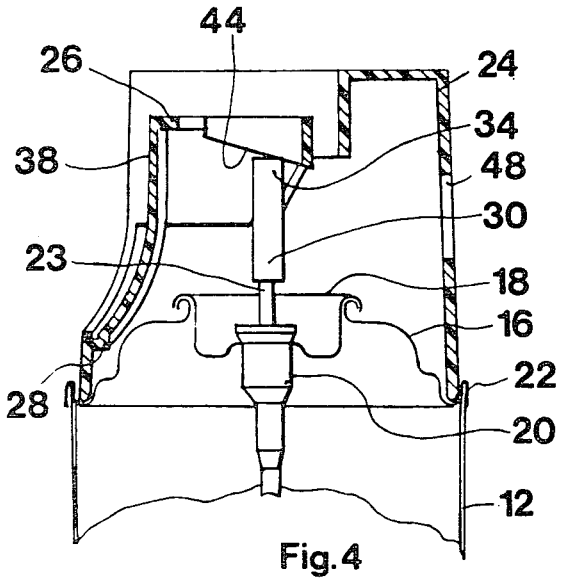
FIG. 4 is an enlarged, fragmentary, partially sectional, side view of the device of FIG. 1, taken along section 4—4 as shown in FIG. 2, illustrating the pressurized package of this invention in an unactuated condition.
Figure 7:
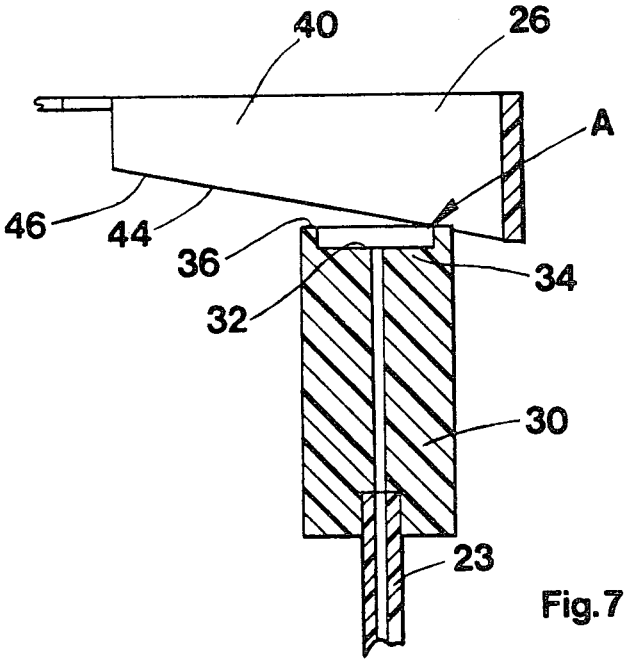
FIG. 7 is a further enlarged, fragmentary view of FIG. 4.

Overhang 40 further includes a downward-facing wedging surface 44 adjacent to opening 42. Wedging surface 44 is engageable with circular ridge 36 at a position radially opposite the hinge position, that is, on the other side of the axis defined by valve stem 23. Wedging surface 44 includes two substantially parallel edges 46 extending across circular ridge 36. Parallel edges 46 are inclined, as best illustrated in FIGS. 4, 5 and 7, to contact circular ridge 36 at points A and B as shown in FIGS. 6 and 7. Points A and B are centered radially opposite the position of hinge 28.

Hinge 28 is axially spaced from circular ridge 36 such that radial depression of finger-contact surface 38 will provide substantial movement of wedging surface 44 of overhang 40 with respect to circular ridge 36 of extension 30. Hinge 28 is axially spaced from circular ridge 36 in a downward direction, a highly preferred orientation.

Parallel edges 46 and circular ridge 36 are preferred forms for the wedging surface and bearing surface, respectively. However, extension 30 could have a stepped sidewall configuration such that parallel edges 46 of wedging surface 44 would contact the extension at a position set back from distal end 34. The bearing surface and wedging surface could be made in other forms which would allow wedging interaction of the tab portion and the extension at a position radially opposite the hinge position such that radial depression of the finger-contact surface would tilt the extension toward the hinge position.

An aperture 48 is defined in the sidewall of fixed portion 24 of actuator-overcap 14 at a position diametrically opposite the position of hinge 28. Pressurized package 10 may be hung on a wall by means of aperture 48, or may be used while gripped in the hand of the user.

To operate pressurized package 10, finger-contact surface 38 of tab portion 26 is radially depressed toward the axis defined by valve stem 23. If the device is mounted on a wall, such depression is in a direction toward the wall. As tab portion 26 is radially depressed, parallel edges 44 of overhang 40 exert wedging pressure on circular ridge 36 at a position radially opposite the position of hinge 28. Such interaction causes extension 30 to tilt toward the position of hinge 28, as illustrated in FIG. 5, actuating the aerosol valve 20. By virtue of such tilting of extension 30, impingement of spray on the wall, when the device is wall-mounted, is avoided.

Actuator-overcap 14 is preferably integrally molded of plastic materials such as high density polyethylene, polypropylene, polyvinyl chloride, or other materials well known to those skilled in the art. Extension 30 is also preferably a plastic piece made by well known methods.

While in the foregoing specification this invention has been described in relation to certain preferred embodiments, and many details have been set forth for the purpose of illustration, it will be apparent to those skilled in the art that the invention is susceptible to additional embodiments and that certain of the details described herein can be varied considerably without departing from the basic principles of the invention.

I claim:

1. In a pressurized package of the type having a container with a tiltable axial valve stem extending upward therefrom, a stem extension with a spray orifice at its distal end, and an actuator-overcap having a fixed portion secured to the container and a tab portion movably secured to the fixed portion through a peripheral hinge, the improvement comprising:

the extension having an upward-facing bearing surface;

the hinge axially spaced from the bearing surface;

the tab portion having a laterally-facing finger-contact surface axially adjacent to the hinge; and the tab portion having an overhang axially adjacent to the distal end, the overhang defining an opening exposing the spray orifice and including a downward-facing wedging surface adjacent to the opening, the wedging surface engageable with the bearing surface at a position radially opposite the hinge position, whereby radial depression of the finger-contact surface will tilt the extension toward the hinge position.

2. The device of claim 1 wherein the bearing surface is at the distal end of the extension.

3. The device of claim 2 wherein the bearing surface is a circular ridge.

4. The device of claim 3 wherein the wedging surface comprises two substantially parallel edges extending across the circular ridge and inclined to contact the ridge at single points which together are centered radially opposite the hinge position.

5. The device of claim 1 wherein the peripheral hinge is axially spaced from the bearing surface in a downward direction.

6. The device of claim 5 wherein the bearing surface is at the distal end of the extension.

7. The device of claim 6 wherein the bearing surface is a circular ridge.

8. The device of claim 7 wherein the wedging surface comprises two substantially parallel edges extending across the circular ridge and inclined to contact the ridge at single points which together are centered radially opposite the hinge position.

* * * * *